United States Patent [19]

Droz

[11] Patent Number: 4,650,077

[45] Date of Patent: Mar. 17, 1987

[54] PORTABLE DISPLAY CASE FOR TIMEPIECES, JEWELS, COSTUME JEWELRY AND LIKE ARTICLES

[75] Inventor: Francois Droz, La Chaux-de-Fonds, Switzerland

[73] Assignee: Attilio Brentini, Paudex, Switzerland

[21] Appl. No.: 808,770

[22] Filed: Dec. 13, 1985

[30] Foreign Application Priority Data

Dec. 24, 1984 [CH] Switzerland ..... 6092/84

[51] Int. Cl.[4] ..... B65D 5/52

[52] U.S. Cl. ..... 206/566; 206/45.14; 206/45.19; 206/487; 206/480; 206/564; 211/13

[58] Field of Search ..... 206/45.14, 45.19, 301, 206/18, 487, 480, 493, 482, 561, 564, 565, 566; 211/13

[56] References Cited

U.S. PATENT DOCUMENTS

| | | | |
|---|---|---|---|
| D. 269,145 | 5/1983 | Druiz et al. | 211/13 X |
| 1,456,613 | 5/1923 | Bartels | 206/561 |
| 1,666,851 | 4/1928 | Good | 206/564 |
| 2,178,652 | 11/1939 | Shields | 206/493 |
| 2,797,806 | 7/1957 | Davis | 206/562 |
| 4,082,183 | 4/1978 | Sturm | 206/45.19 |
| 4,094,409 | 6/1978 | Spranger | 206/301 |
| 4,204,602 | 5/1980 | Dunchock | 211/13 |
| 4,216,858 | 8/1980 | Beauchamp | 206/566 |

FOREIGN PATENT DOCUMENTS

| | | | |
|---|---|---|---|
| 2481909 | 11/1981 | France | 211/13 |
| 225082 | 4/1943 | Switzerland | 211/13 |
| 627931 | 2/1982 | Switzerland | 211/13 |

*Primary Examiner*—William Price
*Assistant Examiner*—Brenda J. Ehrhardt
*Attorney, Agent, or Firm*—Pollock, Vande Sande & Priddy

[57] ABSTRACT

This display case includes a base on which may be arranged a tray of elastic material sufficiently rigid to define, by means of ribs, cells for the storage of the articles to be displayed. When the tray is within the base and the ribs upwardly disposed the display case is set up for transporting the articles. Following inverting of the tray, display elements provided with fastening means in the form of the tongue may be fastened to the tray by insertion of the tongue into a slot which each rib defines on the opposite surface of the tray. Under these conditions the display case is set up for showing the articles. The tray display elements which are readily moved may be stored in a compartment forseen to this purpose. According to a variant the tray may be independent and provided with stiffening elements associated with at least two opposed edges thereof.

14 Claims, 8 Drawing Figures

PORTABLE DISPLAY CASE FOR TIMEPIECES, JEWELS, COSTUME JEWELRY AND LIKE ARTICLES

BACKGROUND OF THE INVENTION

It is known that marketing of articles such as timepieces, jewels and like products implies a presentation by the representative whether this be at the stage of sales by the manufacturer to the wholesaler or sales by wholesaler to retailer. It is preferable that such presentation by effected as attractively and comfortably as possible since it constitues for the representative a non-negligeable element among the sales arguments by means of which he will succeed in convincing the customer.

Thus it has long been known to arrange the articles in a display case having the aspect of a tray provided with cells adapted to accomodate the articles. For example if it concerns watches provided with bracelets the cells generally have an elongated form and are arranged side by side over the entire width of the tray. The cells may be lined with felt and a cover may be added to facilitate easy transport of the assembly. Several trays may likewise be arranged over one another in drawers or collection trunks.

Although such a display case may entirely satisfy the representative it nevertheless has the inconvenience that in order to examine the articles easily they must be removed from their cells and held in the hand.

SUMMARY OF THE INVENTION

The purpose of the invention is to overcome this difficulty and to provide a display case permitting easy display of the articles and comfortable examination thereof.

The invention thus provides a portable display case for timepieces, jewels and like articles comprising a tray exhibiting cells for each article in which said articles may be lodged during transport of the case and further comprising a plurality of display elements adapted to be temporarily fastened to the tray for exhibition of the articles outside the cells of the tray, said elements being detachable therefrom for purposes of transport.

Thus during a presentation it is sufficient to arrange the display elements on the tray and to fasten respectively thereto the articles which will thus be readily visible above the tray.

DESCRIPTION OF THE PREFERRED EMBODIMENT

Figure 1:
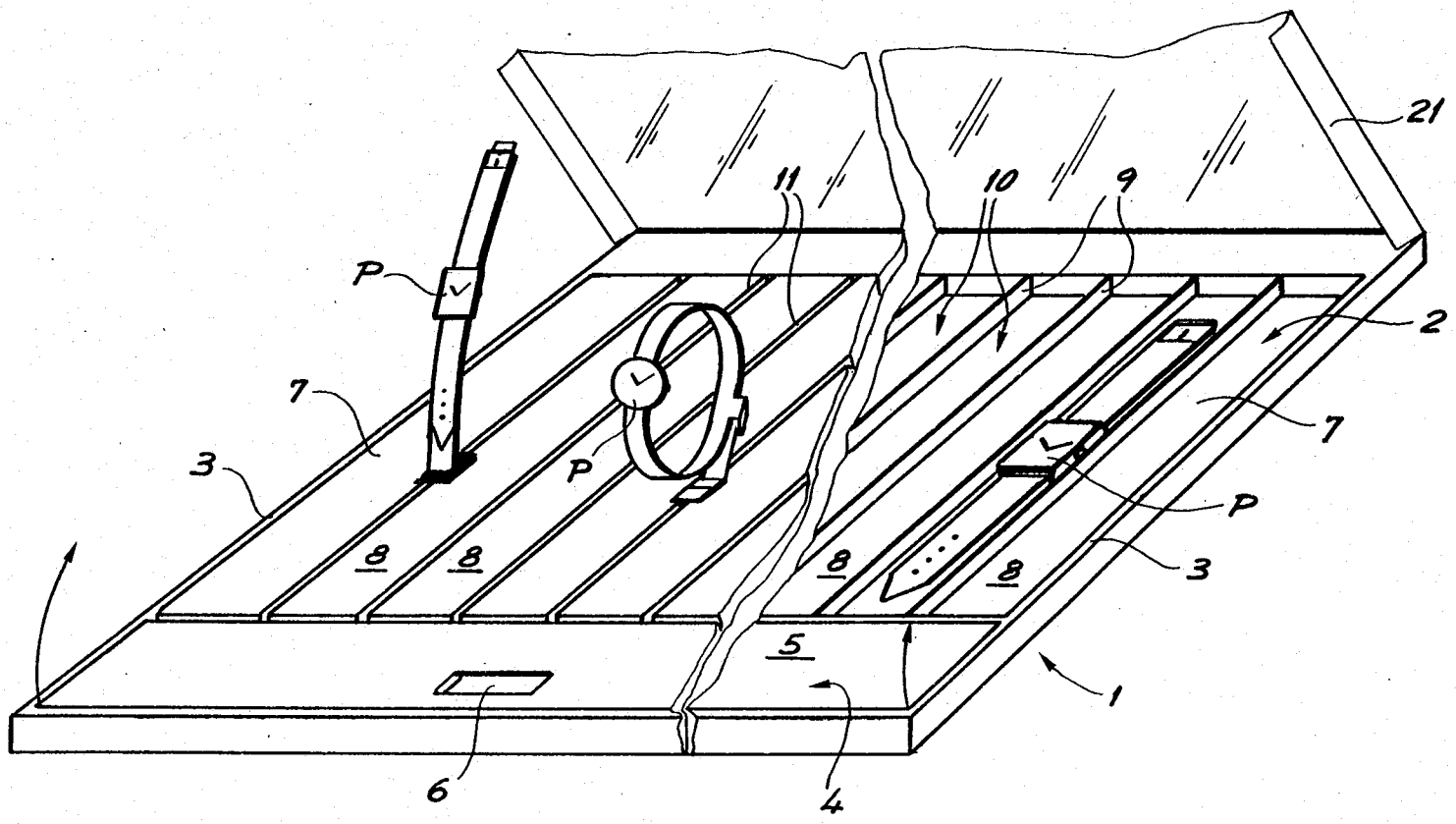
FIG. 1 shows a perspective view of a display case according to the invention.

FIG. 1 shows a display case according to the invention at the left in its presentation arrangement and at the right in its transport arrangement. It includes a base 1 of generally rectangular form obtained from a rigid material; wood or rigid plastic material may suit for example. In order to improve the aesthetic aspect thereof such base may be lined with felt for instance. Over the major portion of its upper surface the base provides a hollowed-out portion 2 of rectangular form so as to leave on the sides only edges 3 of small width while on the front portion thereof there may be provided a zone 4 in which is provided a second hollowed-out portion closed by a cover 5. Manipulating the latter is easily accomplished by means of a handle 6.

A tray 7 for storing and fastening is placed in the hollowed-out portion 2. It is formed by a sheet of preformed plastic which although rigid to a certain extent provides nevertheless a degree of elasticity. Such tray thus includes planar portions 8 alternating with ribs 9 obtained from folds made in the sheet. These elements all extend in a direction parallel to the edges 3 of base 1 when the tray is placed in the hollowed-out portion. The planar portions 8 are all arranged in the same plane while ribs 9 project from this plane but only from a single surface of the tray. When this surface is turned upwardly (right side of FIG. 1) the tray thus defines the elongated cells 10 each adapted to receive a timepiece P or like article.

Figure 2:
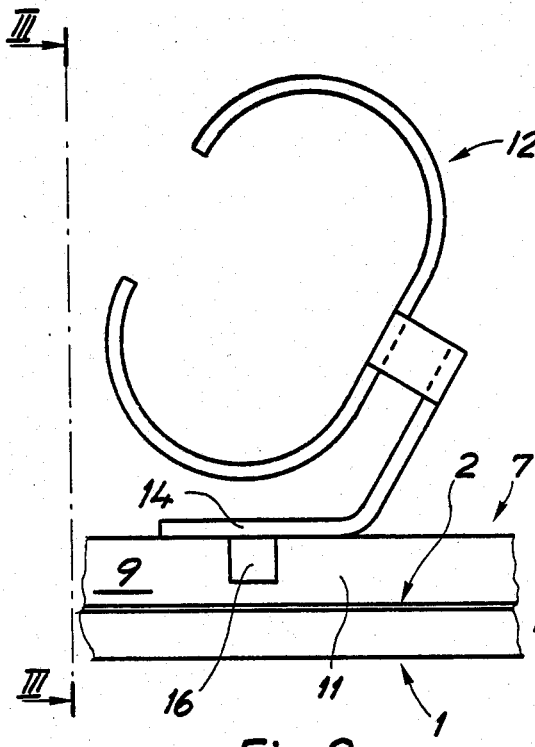
FIG. 2 is a side elevation view of a display element of a first type, the tray being partially shown in vertical cross-section.
Figure 3:
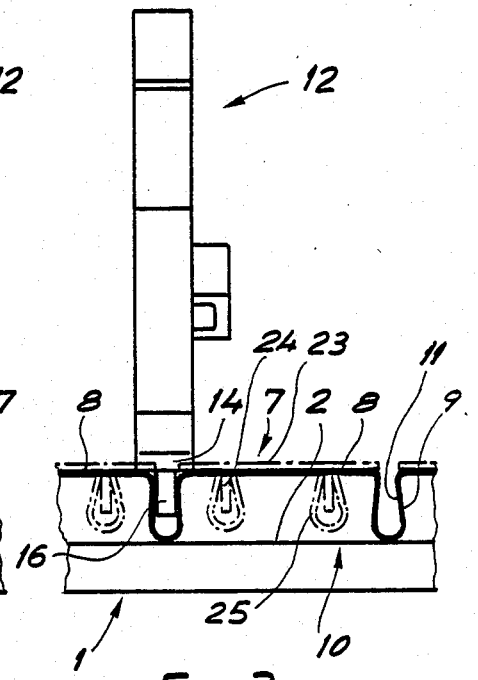
FIG. 3 is a front view of the display element of FIG. 2 according to line III—III thereof.

On the other hand, when the tray is inverted in the hollowed-out opening 2 of base 1 it defines parallel slots 11 (see left hand side of FIG. 1 as well as FIGS. 2 and 3). This latter position of the tray corresponds to the presentation arrangement of the display case according to the invention.

It will be noted that the walls of slots 11, which as is well understood are likewise those defining the ribs in accordance with whether the tray is seen from one side or the other, are slightly narrowed towards the openings so that in order to spread them apart it is necessary to overcome a small elastic force.

This property of tray 7 enables fastening thereto of display elements 12 and 13 when the tray is arranged according to the presentation configuration (FIG. 1 to the left). In the example described herein two types of display elements are provided but it will be readily understood that the invention is not to be considered as limited to these examples.

According to an essential characteristic of the invention each display element 12 and 13 is provided with a base 14, 15 (see also FIGS. 4 to 6) from which a fastening element 16, 20 projects downwardly such being formed in the examples of FIGS. 2 to 5 by a tongue adapted to be inserted anywhere along a groove 11 of the tray 7. During this operation the opening of the groove is slightly enlarged by the tongue the width thereof being chosen to be sufficient to obtain the desired effect. As soon as base 14 seats on the surface (at this time upper surface) of tray 7 there will result a stable mounting of the display element to which may easily be fastened an article so that such may be readily examined.

The display elements have a standard form which may be seen in jeweller's display stands. It will be simply noted in respect of that shown in FIGS. 4 and 5 that it comprises a stem 17 slightly curved and made in two portions 17*a* and 17*b* arranged in a telescopic manner to enable adjustment of the length of the stem as a function of the length of the bracelet of the timepieces to be displayed. The upper portion 17*a* includes to such effect a hook 18 for the bracelet buckle while the lower part includes a stud 19 adapted to be inserted in a hole in the other portion of the bracelet.

Figure 6:
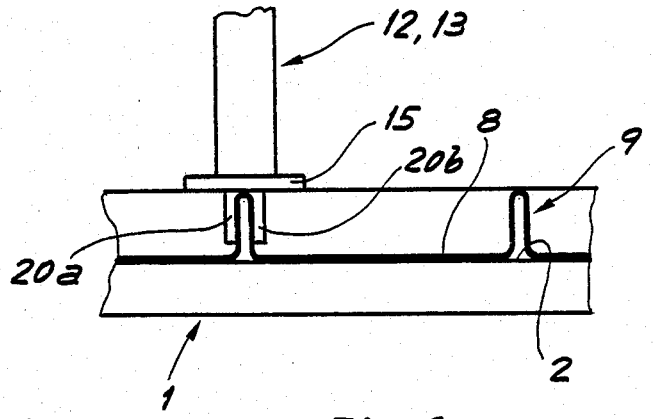
FIG. 6 shows a variant of the display case of the invention by means of a cross-section view analogous to that of FIG. 3.
Figure 4:
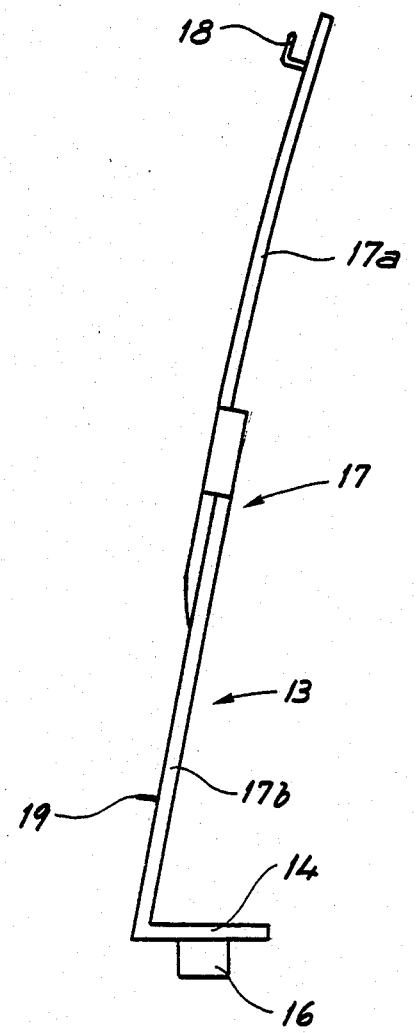
FIG. 4 is a side elevation view of a display element of a second type.
Figure 5:
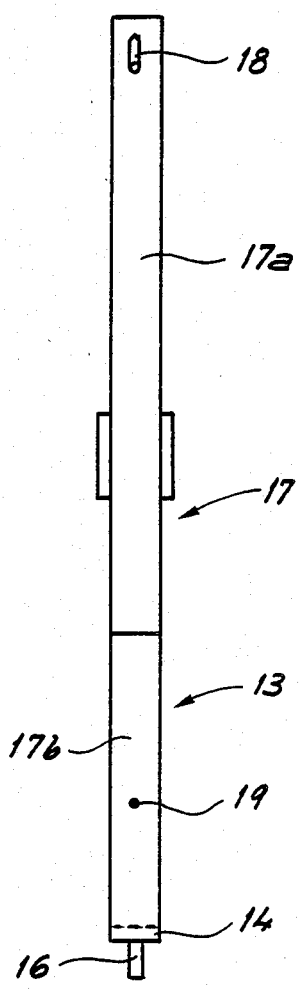
FIG. 5 is a front elevation view thereof.

In accordance with the variant of FIG. 6 each display element 12 or 13, instead of comprising only a single tongue as that of FIG. 2 to 5, provides two thereof 20*a*, 20*b* spaced apart a distance slightly less than the width of a rib 9 of tray 7. It is understood that with this form of the lower portion of the display elements they may be fastened to the surface of the tray shown to the right of FIG. 1, the fastening member of the display element then being placed to straddle the rib. Under these conditions there is no need to invert tray 7 in order that the display case be transformed from a transportation configuration to a display configuration.

A cover 21 may be fasten to base 1 and hinged thereto on one of its edges.

It will likewise be noted that tray 7 may be provided with a lining in order to give it a pleasing aspect.

The advantage of the display case which has just been described is clearly apparent. A collection of articles such as watches may rapidly be shown by the representative at any location without requiring complicated mounting operations or tools.

Figure 7:
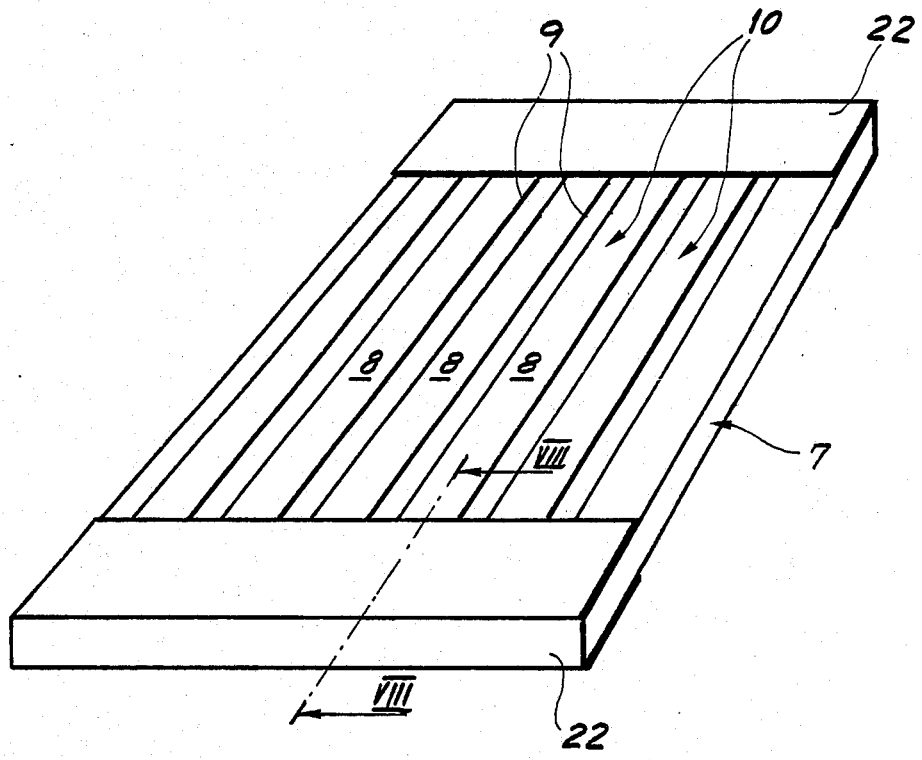
FIG. 7 shows in perspective a further variant of the display case.
Figure 8:
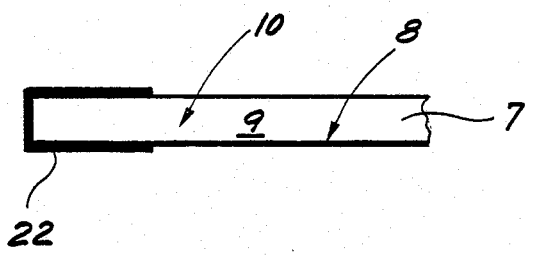
FIG. 8 is an enlarged vertical cross-section of the display case of FIG. 7, a cross-section being taken according to line VIII—VIII thereof.

A further variant of the display case according to the invention may be seen from FIGS. 7 and 8. It will readily be understood that the tray 7 of FIG. 1 has a certain flexibility over its width, that is to say perpendicularly to ribs 9. As is well understood, once arranged in the base, the latter gives the desired rigidity. However according to the variant of FIGS. 7 and 8 rigidity is provided to tray 7 by stiffening members 22 having a U cross-section and straddling the transversal edges of tray 7. These stiffening members are preferably in the form of ornaments or gilded decorations or the like.

Finally within the framework of the invention it is likewise possible to cover the visible surface of the display case with decorating strips 23 such as shown by the dot-dashed lines on FIG. 3 (strips which appear only on this figure). Strips 23 may be fastened to the tray 7 in the same manner as the display elements 12 or 13. To this end they may be provided either with ribs 24 or from place to place fastening feet passing into grooves 25 provided in tray 7 during the formation thereof. The decorating strips may be provided with any desired covering such as felt. One may thus vary whenever desired the aspect of the tray by combinations of colours or the like.

What I claim is:

1. A portable display case for timepieces, jewels and like articles, comprising in combination:

a tray comprising a plurality of rib means and a plurality of connecting tray portions connecting said plurality of rib means to define in said tray a plurality of storage compartments integral with said tray in which said articles may be stowed away during transport of the case; and, a plurality of display elements each having fastening means for temporarily securing it to said tray for exhibition of the articles when outside said storage compartments of said tray;

each of said rib means including elastic means for resiliently engaging said fastening means so as to resiliently retain said display elements on said tray in an exhibition position for displaying the articles and to enable removal of said elements from said tray for the purpose of transporting said display case with the articles stowed in said tray compartments.

2. A portable display case as set forth in claim 1, wherein each display element comprises a base and securing means extending from said base for securing one of said articles thereto, said fastening means extending from said base in an opposite direction with repect to said securing means and being so arranged as to be resiliently clamped by said elastic means when said display element is in its exhibition position.

3. A portable display case as set forth in claim 2, wherein each of said rib means comprises a hollow rib extending outwardly from one side of said tray, each of said hollow ribs having opposing sidewalls of elastic material; wherein each of said connecting tray portions extends laterally between a pair of said ribs one on either side of one of said compartments; wherein the fastening means of each of said display elements includes a projecting tongue; and wherein the opposing sidewalls of each hollow rib define a groove extending inwardly from the other side of said tray opposite from said ribs, the width of said groove being less than the width of said tongue such that said sidewalls resiliently engage said tongue when said display element is in its exhibition position.

4. A portable display case as set forth in claim 2, wherein each of said rib means comprises a hollow rib extending outwardly from one side of said tray, each of said hollow ribs having opposing sidewalls of elastic material; wherein each of said connecting tray portions extends laterally between a pair of said ribs one on either side of one of said compartments; wherein the fastening means of each of said display elements includes a pair of projecting tongues one spaced laterally apart from the other to provide a groove for receiving at least a portion of one of said ribs; and wherein the outer edges of said opposing sidewalls of each of said ribs are connected to provide a resilient ridge the width of which is greater than the width of said groove such that said tongues are resiliently engaged by said ridge when said display element is in its exhibition position.

5. A portable display case as set forth in claim 2, wherein each of said rib means comprises a hollow rib extending outwardly from one side of said tray, each of said hollow ribs having opposing sidewalls of elastic material; wherein each of said connecting tray portions extends laterally between a pair of said ribs one on either side of one of said compartments; wherein said display elements include a first type and a second type; wherein the fastening means of said first type of display elements includes a sole projecting tongue; wherein the opposing sidewalls of each hollow rib define a tray groove extending inwardly from the other side of said tray opposite from said ribs, the width of said tray groove being less than the width of said sole tongue such that said sidewalls will resiliently engage the tongue of said first type of display element when it is in its exhibition position; wherein the fastening means of said second type of display elements includes a pair of projecting tongues one spaced laterally apart from the other to provide a display element groove for receiving at least a portion of one of said ribs; and wherein the outer edges of said opposing sidewalls of each of said ribs are connected to provide a resilient ridge the width of which is greater than the width of said display element groove such that said pair of tongues will be resiliently engaged by said ridge when said second type of display element is in its exhibition position.

6. A portable display case as set forth in claim 1, wherein the storage compartments defined by said rib means and said connecting tray portions are elongated and have a length and transverse width sufficient to receive and stow a timepiece comprising a watch case and a wristlet connected to said watch case.

7. A portable display case as set forth in claim 1 wherein said tray is formed of elastic material and said rib means and said connecting tray portions are formed integrally with said tray.

8. A portable display case as set forth in claim 7 further comprising a rigid base hollowed-out to accomodate said tray.

9. A portable display case as set forth in claim 7 including stiffening elements associated with at least two opposed edges of the tray.

10. A portable display case as set forth in claim 7 wherein said tray is fashioned from a preformed sheet of elastic plastic material and said connecting tray portions comprise planar portions of said sheet extending parallel to one of its edges and separated from one another by said rib means, said rib means comprising ribs formed of folds made in said sheet, said ribs extending from one of the surfaces of said planar portions so as to define the storage compartments.

11. A portable display case as set forth in claim 10 wherein said ribs are hollow and form grooves extending from the other of the surfaces of said planar portions, and wherein said fastening means of each of said display elements comprises a tongue adapted to be elastically inserted into any of the grooves formed by the tray ribs when said tray is inverted so that the ribs face downwardly.

12. A portable display case as set forth in claim 10 wherein said fastening means of each of said display elements is formed by two parallel tongues spaced apart by a distance slightly less than the thickness of one of said ribs, said tongues being adapted to be placed on either side of said rib so as to fix the corresponding element thereto by straddling thereof.

13. A portable display case as set forth in claim 1 further including a receptacle for storing said display elements during transport.

14. A portable display case as set forth in claim 11 further comprising a decoration strip arranged to be removably fastened to the tray, said decoration strip having foot means extending from one surface thereof and said tray being integrally formed with auxiliary rib means having elastic means for resiliently engaging said foot means so as to resiliently retain said decoration strip on said tray in an exhibition position and to enable removal of said decoration strip from said tray for the purpose of transporting said display case.

* * * * *